US006208960B1

(12) United States Patent
Gigi

(10) Patent No.: US 6,208,960 B1
(45) Date of Patent: Mar. 27, 2001

(54) REMOVING PERIODICITY FROM A LENGTHENED AUDIO SIGNAL

(75) Inventor: Ercan F. Gigi, Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/212,630

(22) Filed: Dec. 16, 1998

(30) Foreign Application Priority Data

Dec. 19, 1997 (EP) ..... 97204029

(51) Int. Cl.[7] ..... G10L 21/00
(52) U.S. Cl. ..... 704/220; 704/208; 704/500
(58) Field of Search ..... 704/205, 207, 704/500, 501, 502, 503, 504, 200, 201, 260, 258, 220, 208, 214

(56) References Cited

U.S. PATENT DOCUMENTS 5,479,564 * 12/1995 Vogten et al. ..... 704/267
5,611,002 * 3/1997 Vogten et al. ..... 704/267

FOREIGN PATENT DOCUMENTS

0527527A2 2/1993 (EP) ..... G10L/3/02
0527529A2 2/1993 (EP) ..... G10L/3/02
0363233A1 4/1990 (FR) ..... G10L/5/04

* cited by examiner

*Primary Examiner*—Richemond Dorvil
(74) *Attorney, Agent, or Firm*—Daniel J. Piotrowski

(57) ABSTRACT

An audio equivalent input signal is divided into a sequence of overlapping or adjacent signal segments. A lengthened signal is synthesized by systematically maintaining or repeating respective signal segments of the sequence of segments. Repeating non-periodic segments, such as a voiceless part of a speech signal or noise in music, results in audible artefacts. The introduced periodicity is broken by dividing a signal section originating from one non-periodic source signal segment into a second sequence of signal segments with at least one of the signal segments having a duration not equal to a duration of the source signal segment and not equal to a multiple of the duration of the source signal segment. Signal segments of the second sequence are shuffled.

9 Claims, 15 Drawing Sheets

REMOVING PERIODICITY FROM A LENGTHENED AUDIO SIGNAL

BACKGROUND OF THE INVENTION

The invention relates to a method for lengthening an audio equivalent input signal, the method comprising:

positioning a first chain of mutually overlapping or adjacent time windows with respect to the signal; each time window being associated with a respective window function, forming a first sequence of signal segments by weighting the signal according to the associated window function of a respective window of the first chain of windows; and synthesising a lengthened audio signal by systematically maintaining or repeating respective signal segments of the first sequence of segments.

The invention further relates to an apparatus for lengthening an audio equivalent input signal, the apparatus comprising:

positioning means for positioning a first chain of mutually overlapping or adjacent time windows with respect to the signal; each time window being associated with a respective window function, segmenting means for forming a first sequence of signal segments by weighting the signal according to the associated window function of a respective window of the first chain of windows; and synthesising means for synthesising a lengthened audio signal by systematically maintaining or repeating respective signal segments of the first sequence of segments.

From EP-A 0527527, EP-A 0527529 and EP-A 0363233 a method and apparatus are known for lengthening an audio equivalent signal. The method and apparatus are typically used for speech synthesis. For speech synthesis usually a text is converted to speech by selecting speech fragments, representing sampled speech, from a set of stored speech fragments and concatenating the selected speech fragments to form a basic speech signal. The speech fragments may, for instance, represent diphones. Since the speech fragments have a given duration and pitch, the duration and usually also the pitch of the obtained basic speech signal is manipulated to obtain natural sounding speech with a given prosody. The manipulation is performed by breaking the basic speech signal into segments. The segments are formed by positioning a chain of windows along the signal. Successive windows are usually displaced over a duration similar to the local pitch period. In the system of EP-A 0527527 and EP-A 0527529, referred to as the PIOLA system, the local pitch period is automatically detected and the windows are displaced according to the detected pitch duration. In the so-called PSOLA system of EP-A 0363233 the windows are centred around manually determined locations, so-called voice marks. The voice marks correspond to periodic moments of strongest excitation of the vocal cords. The speech signal is weighted according to the window function of the respective windows to obtain the segments. A lengthened signal is obtained by repeating segments (e.g. repeating one in four segments to get a 25% longer signal). Similarly, a shortened signal can be achieved by suppressing segments. The same technique can be used for manipulating the duration of other forms of audio equivalent signals, such as music. For music, the displacement of windows may be based on the dominant local frequency component, similar to using the pitch or voice marks for speech signals. The duration of a music or music/speech signal may be manipulated in order to fit the signal to a given frameworks, such as fitting soundtrack(s) to a video track.

For manipulating the length of an audio signal, the window function may be a block form. This results in effectively cutting the input signal into non-overlapping neighbouring segments. Particularly for manipulating the prosody of a speech signal, it is preferred to use windows which are wider than the displacement of the windows (i.e. the windows overlap). Preferably each window extends to the centre of the next window. In this way each point in time of the speech signal is covered by two windows. The window function varies as a function of the position in the window, where the function approaches zero near the edge of the window. Preferably, the window function is "self-complementary" in the sense that the sum of the two window functions covering the same time point in the signal is independent of the time point (an example of such window function is a bell-shaped function formed by the square of a cosine with its argument running proportionally to time from minus ninety degrees at the beginning of the window to plus ninety degrees at the end of the window). Using windows which are wider than the displacement results in obtaining overlapping segments. The self complementary property of the window function ensures that by superposing the segments in the same time relation as they are derived, the original signal is retrieved. A pitch change of locally periodic signals (like for example voiced speech or music) can be obtained by placing the segment signals at different relative time points before superpositioning the segments. To form, for example, an output signal with increased pitch, the segments are superposed with a compressed mutual centre to centre distance as compared to the distance of the segments as derived from the original signal. The length of the segments are kept the same. Changing the time position of the segments results in an output signal which differs from the input signal in that it has a different local period, but the envelope of its spectrum remains approximately the same. Perception experiments have shown that this yields a very good perceived speech quality even if the pitch is changed by more than an octave.

The segmenting technique can also be used to manipulate the duration of parts of the audio equivalent signal which do not have a periodic component. For a speech signal this relates, for instance, to predominantly voiceless parts and for music to predominantly noise parts. For these parts of the signal the windows are displaced, for instance, by using the displacement used for the last segment with a distinguishable periodic component or using an average displacement value, such as 10 msec. for a male voice. In principle, also the spectral content of the signal may be analysed to identify fragments wherein the spectral content does not significantly change. If it is then desired to lengthen the signal by a given factor a/b (e.g. the signal should be lengthened by a factor 5/4), the fragment may be broken into b segments (or a multiple of b) and, by repeating the segments, the b input segment can give a output segments (e.g. repeating one in four segments).

In practice, it has been found that lengthening non-periodic parts in this way produces audible artefacts if the duration of the signal is substantially increased, e.g. by a factor of two or more. Although the segments itself does not contain identifiable periodic components, the repeating of the segments introduces periodicity. This is observed as a sound similar to a person blowing along the end of a tube. To avoid such artefacts, usually non-periodic parts of the input signal are not lengthened. Particularly for speech synthesis it is desired to be able to significantly increase the length of a speech signal. For a natural sounding audio signal it is desired that also the voiceless parts of the signal can be lengthened.

SUMMARY OF THE INVENTION

It is an object of the invention to provide a method and apparatus of the kind set forth capable of lengthening an audio equivalent signal in its entirety, including non-periodic parts, at a good quality.

To meet the object of the invention, the method is characterised in that the method comprises the steps of identifying a signal section in the lengthened audio signal which is synthesised from one of the signal segments, referred to as the source signal segment, by maintaining and at least once repeating the source signal segment; the source signal segment substantially having no periodic component; and breaking periodicity in the signal section caused by repeating the source signal segment by:

positioning a second chain of mutually overlapping or adjacent time windows with respect to the signal section; at least some of the time windows of the second chain having a duration not equal to a duration of the source signal segment and not equal to a multiple of the duration of the source signal segment;

forming a second sequence of signal segments by weighting the signal section with the associated window function of a respective window of the second chain of windows; and generating an audio output signal from the lengthened audio signal by shuffling signal segments of the second sequence of signal segments. The periodicity introduced in a signal section of the lengthened signal by repeating a source segment one or more times is broken by dividing the signal section into segments and shuffling the segments. By ensuring that the segments of the second sequence not all have the same length as the original source segment (or a multiple of it), it is avoided that the shuffling would simply rearrange segments with exactly the same signal content. The windows of the second chain may have any suitable shape (window function), such as a block wave to form non-overlapping, neighbouring segments or overlapping windows, such as bell-shaped windows. Preferably, the second chain of windows are based on the same shape as the windows of the first chain, allowing re-use of available signal processing means. Advantageously, overlapping windows are used for the first chain, allowing the method to be also used for changing the pitch of the audio equivalent input signal.

In an embodiment as defined in the dependent claim 2, at least some of the time windows of the second chain of time windows are substantially shorter than the source signal segment. The artefacts audible in the lengthened signal are caused by repeating specific spectral elements of the source segment at exactly the same time position in each of the segments derived from the source segment. Consequently, all the specific spectral elements are repeated at the same frequency (resulting from the displacement of the windows of the first chain) and contribute to the audible artefact. By using short time windows in the second chain and shuffling the resulting short segments, the spectral elements of the source segments are to a certain degree isolated and smeared out, breaking the repetition further. A segment of the second sequence may be shuffled to a position anywhere in the entire section (i.e. anywhere within the part of the lengthened signal which originates from the same source segment). If so desired, the shuffling may also be restricted to a position within one segment of the lengthened audio signal.

In an embodiment as defined in the dependent claim 3, the duration of the selection of the time windows of the second chain is at least a factor 4 less than duration of the source signal segment. It has been found that if the segments of the identified section are each broken into at least four smaller segments (which are then shuffled), the artefacts are significantly reduced. By using six or more smaller segments artefacts are hardly audible any more.

In an embodiment as defined in the dependent claim 4, the durations of time windows of the second chain of time windows are selected from a predetermined range such that the selected durations are substantially equally distributed over the range. If, for instance, a source segment of 10 msec. is divided into 10 segments of 1 msec. each, which are then shuffled, the use of the fixed length smaller segments introduces periodicity. In this example a 1 kHz. repetition (and harmonics thereof) could become audible (albeit considerably less than the original repetition). By using different length windows for the second chain, it is avoided that such a repetition is introduced.

In an embodiment as defined in the dependent claim 5, an upper boundary of the range is at least a factor 1.5 higher than a lower boundary of the range. In this way sufficient variation in duration of the segments can be achieved to avoid repetition.

In an embodiment as defined in the dependent claim 6, the upper boundary is substantially a factor 2 higher than the lower boundary. Experiments have shown that by varying the duration of the small segments by a factor of 2 very good results are achieved in avoiding repetition.

To achieve the object of the invention, the apparatus is characterised in that the apparatus comprises:

identification means for identifying a signal section in the lengthened audio signal which is synthesised from one of the signal segments, referred to as the source signal segment, by maintaining and at least once repeating the source signal segment; the source signal segment substantially having no periodic component; and means for breaking periodicity in the signal section caused by repeating the source signal segment by:

causing the positioning means to position a second chain of mutually overlapping or adjacent time windows with respect to the signal section; at least some of the time windows of the second chain having a duration not equal to a duration of the source signal segment and not equal to a multiple of the duration of the source signal segment;

causing the segmenting means to form a second sequence of signal segments by weighting the signal section with the associated window function of a respective window of the second chain of windows; and generating an audio output signal from the lengthened audio signal by shuffling signal segments of the second sequence of signal segments. These and other aspects of the invention will be apparent from and elucidated with reference to the embodiments shown in the drawings.

DESCRIPTION OF THE PREFERRED EMBODIMENTS

Figure 1:
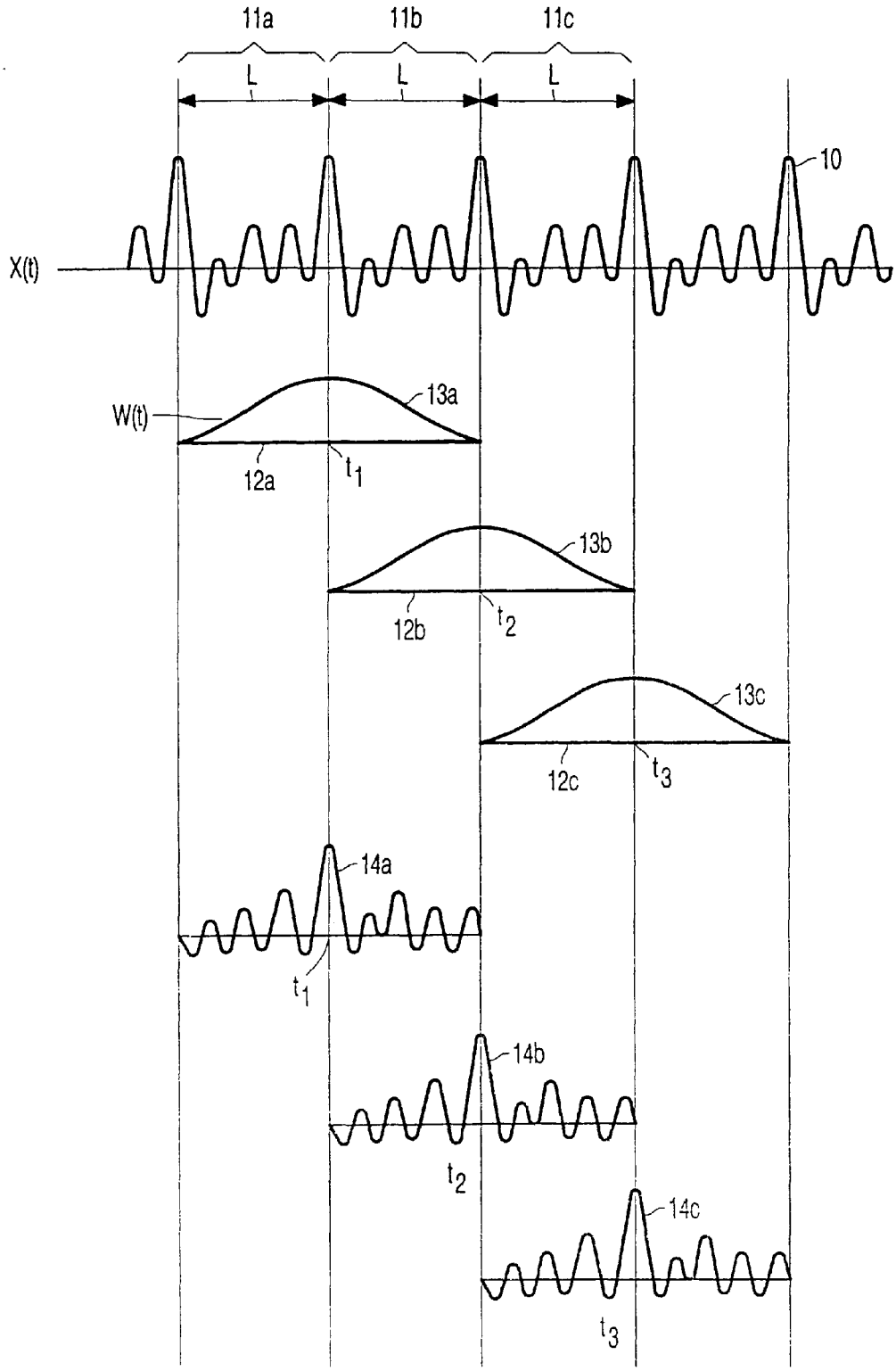
FIG. 1 PRIOR ART
FIG. 1 schematically shows the result of steps of the known method for breaking the audio equivalent input signal into segments.

FIG. 1 shows the steps of the known method for lengthening an audio equivalent input signal "X" 10, such as a speech or music signal. The method and apparatus are very suitable for speech synthesis. For speech synthesis usually a text is converted to speech by selecting speech fragments, representing sampled speech, from a set of stored speech fragments and concatenating the selected speech fragments to form a basic speech signal. The speech fragments may, for instance, represent diphones. The concatenated signal usually does not sound naturally, since each of the concatenated speech fragments have their own specific duration and pitch, which does not match a duration and pitch desired for the sentence to be reproduced. To this end, the duration and usually also the pitch of the obtained basic speech signal is manipulated to obtain natural sounding speech with a given prosody. The manipulation is performed by breaking the basic speech signal into segments and operating on the segments. In FIG. 1, the technique is illustrated for a periodic section of the audio equivalent signal 10. In this section, the signal repeats itself after successive periods 11*a*, 11*b*, 11*c* of duration L. For a speech signal, such a duration is on average approximately 5 msec. for a female voice and 10 msec. for a male voice. A chain of time windows 12*a*, 12*b*, 12*c* are positioned with respect to the signal 10. In FIG. 1 overlapping time windows are used, centred at time points "$t_i$" (i=1,2,3 . . . ). The shown windows each extend over two periods "L", starting at the centre of the preceding window and ending at the centre of the succeeding window. As a consequence, each point in time is covered by two windows. Each time window 12*a*, 12*b*, 12*c* is associated with a respective window function W(t) 13*a*, 13*b*, 13*c*. A first chain of signal segments 14*a*, 14*b*, 14*c* is formed by weighting the signal 10 according to the window functions of the respective windows 12*a*, 12*b*, 12*c*. The weighting implies multiplying the audio equivalent signal 10 inside each of the windows by the window function of the window. The segment signal $S_i(t)$ is obtained as $$S_i(t)=W(t)\ X(t-t_i)$$

Figure 2A:
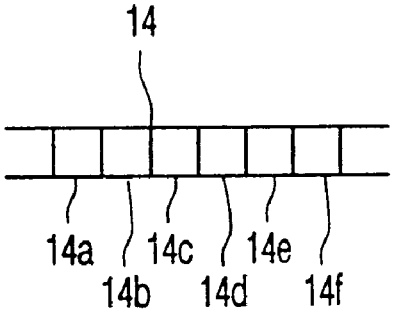
FIG. 2A PRIOR ART
FIG. 2 illustrates the prior art method of lengthening a periodic part of the signal.
Figure 2B:
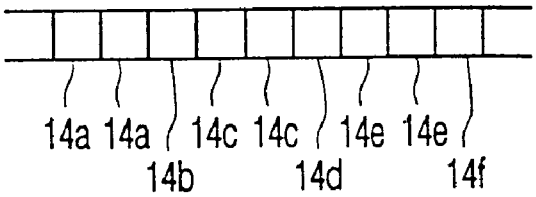
FIG. 2B PRIOR ART
Figure 2C:
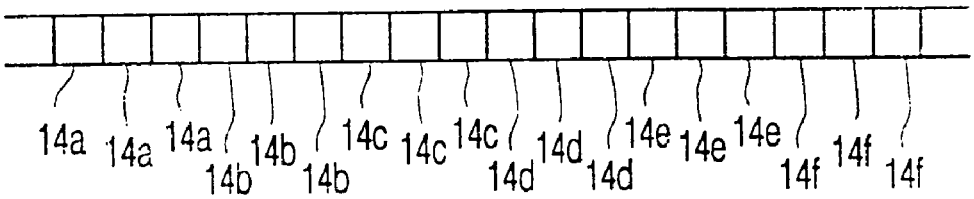
FIG. 2C PRIOR ART

FIG. 2 illustrates forming a lengthened audio signal by systematically maintaining or repeating respective signal segments. In FIG. 2A the first sequence 14 of signal segments 14*a* to 14*f* is shown. FIG. 2B shows a signal which is 1.5 times as long in duration. This is achieved by maintaining all segments of the first sequence 14 and systematically repeating each second segment of the chain (e.g. repeating every "odd" or every "even" segment). The signal of FIG. 2C is lengthened by a factor of 3 by repeating each segment of the sequence 14 three times. It will be appreciated that the signal may be shortened by using the reverse technique (i.e. systematically suppressing/skipping segments).

For lengthening the signal the windows may in principle be positioned in a non-overlapping manner, simply adjacent to each other. For this, the window function may be a straightforward block wave:

$$W(t)=1,\ \text{for}\ 0\leqq t<L$$

$$W(t)=0,\ \text{otherwise.}$$

If the same technique is also used for changing the pitch of the signal it is preferred to use overlapping windows, for instance like the ones shown in FIG. 1. Advantageously, the window function is self complementary in the sense that the sum of the overlapping window functions is independent of time:

$$W(t)+W(t-L)=\text{constant},\ \text{for}\ 0\leqq t<L.$$

This condition is, for instance, met when $$W(t)=\tfrac{1}{2}+A(t)\cos\left[180t/L+\phi(t)\right]$$

where A(t) and φ(t) are periodic functions of t, with a period of L. A typical window function is obtained when A(t)=½ and φ(t)=0. The segments $S_i(t)$ are superposed to obtain the output signal Y(t). In order to change the pitch the segments are superposed at new positions $T_i$, differing from the original positions $t_i$ (i=1,2,3 . . . ). To raise the pitch value, the centres of the segment signals are positioned closer together. To lower the pitch value, the segments are positioned further apart. Finally, the segment signals are summed to obtain the superposed output signal Y:

$$Y(t)=\Sigma_i S_i(t-T_i)$$

(In the example of FIG. 1 with the windows being two periods wide, the sum is limited to indices i for which $-L<t-T_i<L$). By nature of its construction this output signal Y(t) will be periodic if the input signal 10 is periodic, but the period of the output differs from the input period by a factor $$(t_i-t_{i-1})/(T_i-T_{i-1})$$

that is, as much as the mutual compression/expansion of distances between the segments as they are placed for the superpositioning. If the segment distance is not changed, the output signal Y(t) exactly reproduces the input audio equivalent signal X(t).

It will be appreciated that a side effect of raising the pitch is that the signal gets shorter. This may be compensated by lengthening the signal as described above.

The known method transforms periodic signals into new periodic signals with a different period but approximately the same spectral envelope. The method may be applied equally well to signals which have a locally determined period, like for example voiced speech signals or musical signals. For these signals, the period length L varies in time, i.e. the i-th period has a period-specific length $L_i$. In this case, the length of the windows must be varied in time as the period length varies, and the window functions W(t) must be stretched in time by a factor $L_i$, corresponding to the local period, to cover such windows:

$$S_i(t)=W(t/L_i)\ X(t-t_i)$$

For self-complementary, overlapping windows, it is desired to preserve the self-complementarity of the window functions. This can be achieved by using a window function with separately stretched left and right parts (for t<0 and t>0 respectively)

$$S_i(t)=W(t/L_i)\,X(t+t_i)\ (-L_i<t<0)$$

$$S_i(t)=W(t/L_{i+1})X(t+t_i)\ (0<t<L_{i+1})$$

each part being stretched with its own factor ($L_i$ and $L_{i+1}$ respectively). These factors are identical to the corresponding factors of the respective left and right overlapping windows.

Experiments have shown that locally periodic input audio equivalent signals manipulated in the way described above lead to output signals which to the human ear have the same quality as the input audio equivalent signal, but with a different pitch and/or duration.

FIG. 1 shows windows 12 which are positioned centred at voice marks, that is, points in time where the vocal cords are excited. Around such points, particularly at the sharply defined point of closure, there tends to be a larger signal amplitude (especially at higher frequencies). For signals with their intensity concentrated in a short interval of the period, centring the windows around such intervals will lead to most faithful reproduction of the signal. Alternatively, it is known from EP-A 0527527 and EP-A 0527529 that, in most cases, for good perceived quality in speech reproduction it is not necessary to centre the windows around voice marks corresponding to moments of excitation of the vocal cords or for that matter at any detectable event in the speech signal. Rather, good results can be achieved by using a proper window length and regular spacing. Even if the window is arbitrarily positioned with respect to the moment of vocal cord excitation, and even if positions of successive windows are slowly varied good quality audible signals are achieved. For such a technique, the windows are placed incrementally, at local period lengths apart, without an absolute phase reference. The local period length, that is, the pitch value, can be determined automatically using any suitable known method. Typically, pitch detection is based on determining the distance between peaks in the spectrum of the signal, such as for instance described in "Measurement of pitch by subharmonic summation" of D. J. Hermes, Journal of the Acoustical Society of America, Vol. 83 (1988), no.1, pages 257–264. Other methods select a period which minimises the change in signal between successive periods.

The same lengthening technique as described above can also be used for lengthening parts of the audio equivalent input signal with no identifiable periodic component. For a speech signal, an example of such a part is an unvoiced stretch, that is a stretch containing fricatives like the sound "ssss", in which the vocal cords are not excited. For music, an example of a non-periodic part is a "noise" part. To lengthen the duration of substantially non-periodic parts, in a way similar as for the periodic parts, windows are placed incrementally with respect to the signal. The windows may still be placed at manually determined positions. Alternatively successive windows are displaced over a time distance which is derived from the pitch period of periodic parts, surrounding the non-period part. For instance, the displacement may be chosen to be the same as used for the last periodic segment (i.e. the displacement corresponds to the period of the last segment). The displacement may also be determined by interpolating the displacements of the last preceding periodic segment and the first following periodic segment. Also a fixed displacement may be chosen, which for speech preferably is sex-specific, e.g. using a 10 msec. displacement for a male voice and a 5 msec. displacement for a female voice.

Figure 3:
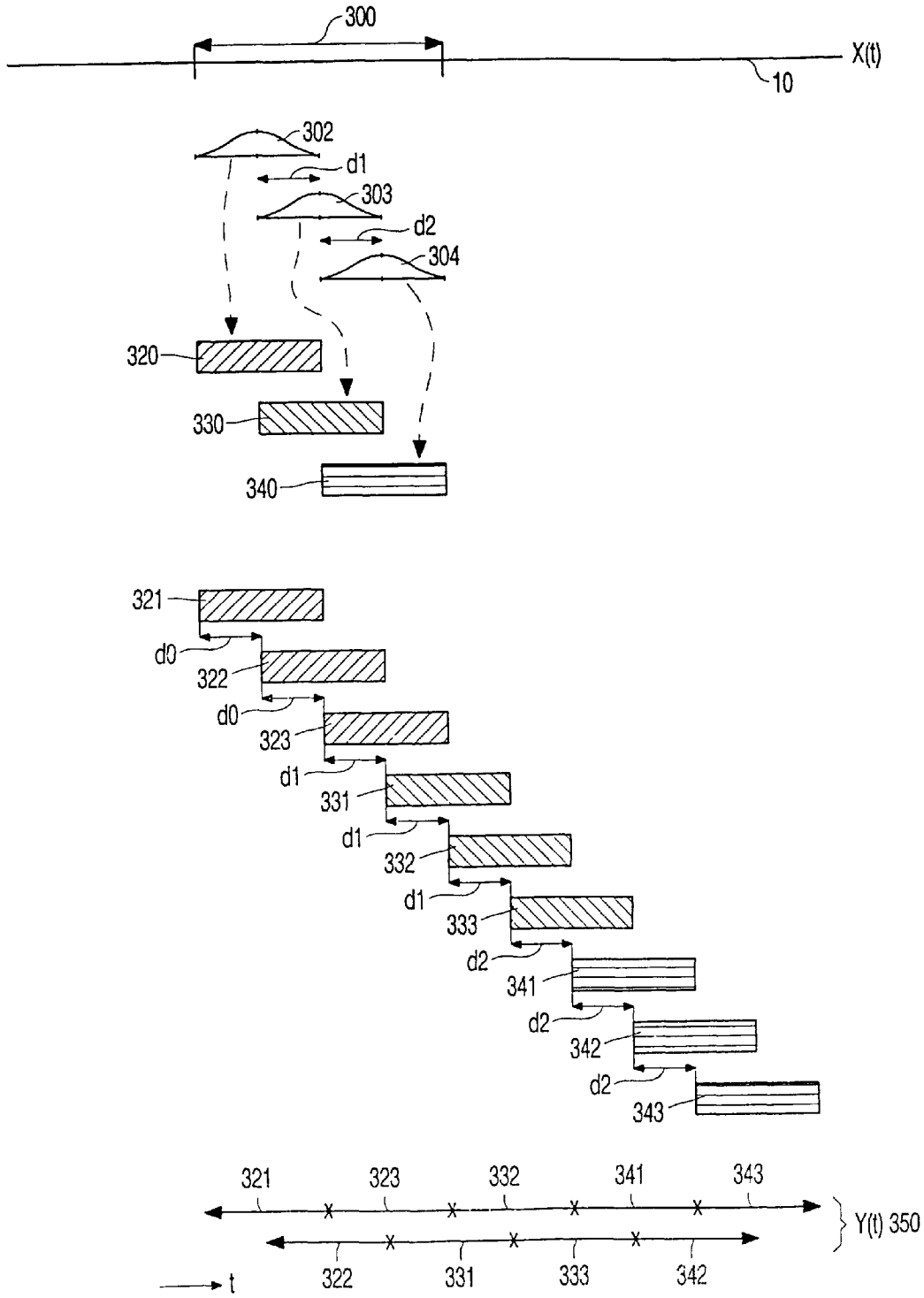
FIG. 3 illustrates lengthening a non-periodic part of the signal.

FIG. 3 shows a non-periodic section 300 of the audio equivalent input signal 10. The signal section 300 is divided into three segments 320, 330 and 340. In this case overlapping windows 302, 303 and 304 were used to form the segments. As an example, a lengthened signal is created by repeating each of the segments 320, 330 and 340 three times. The lengthened signal Y(t) 350 is formed by summing the thus formed segments 321, 322, 323, 331, 332, 333, 341, 342 and 343. In this example, segment 321 is placed at the same position as segment 320. Segment 322 is displaced over a time distance $d_0$ with respect to 321 which is similar to the distance over which the window used to create segment 320 was displaced in the input signal X with respect to the preceding window (not shown). If non-overlapping windows were used to form the segments 320, 330 and 340, this displacement is the width of the window. If overlapping windows of a width of 2L are used, the displacement is L as described earlier. Segment 323 is also displaced over $d_0$ with respect to segment 322. In a similar manner, the segments 331, 332, 333, 341, 342, and 343 are displaced as shown in the figure. Normally, the non-periodic segments 320, 330 and 340 are formed by displacing the windows 302, 303, and 304 over a same distance. In such a case the shown displacements $d_0$, $d_1$, and $d_2$ are all the same. If desired the distances may also be different, for instance if a location-specific interpolation of the displacements of the last preceding periodic segment and the first following periodic segment is used.

Figure 4A:
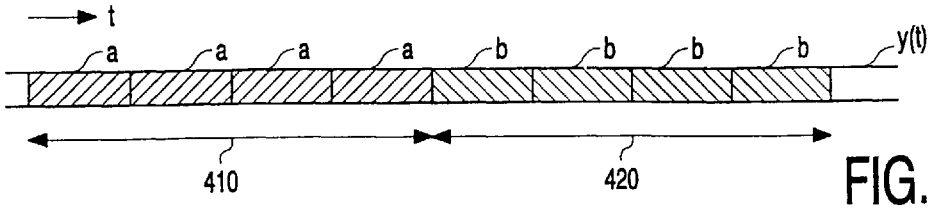
FIG. 4 illustrates identifying a signal section synthesised from a non-periodic segment.
Figure 4B:
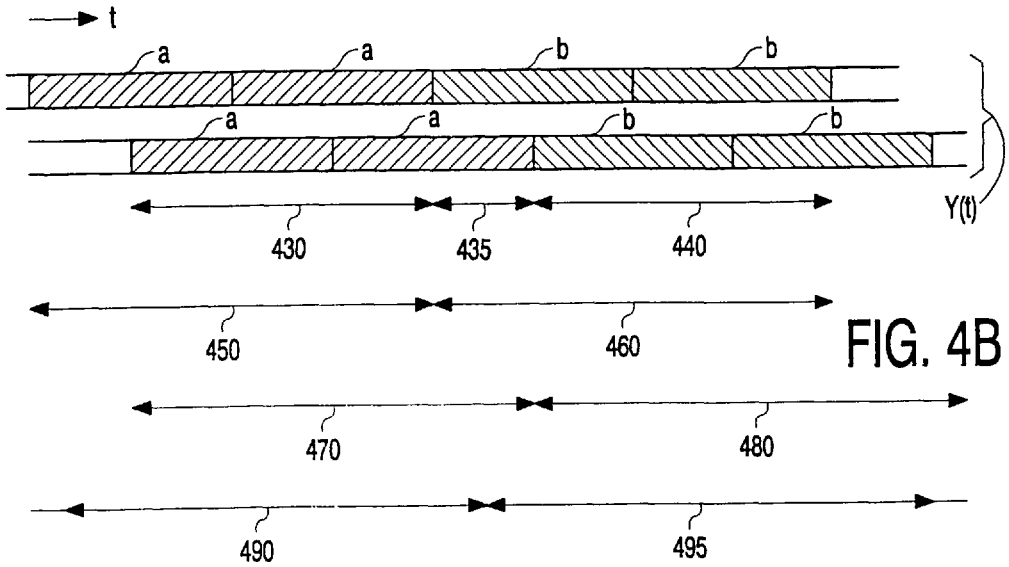

According to the invention a signal section in the lengthened audio signal Y(t) 350 is identified which is synthesised from one source signal segment. FIG. 4A illustrates two such signal sections 410 and 420, each being formed by four times repeating a source segment (respectively indicated with a and b). In this example, the source segments are non-overlapping. FIG. 4B illustrates a similar situation wherein the source segments are overlapping. In this case, the section of the signal Y(t) which relates to the same source segment can be defined in various ways. In a restrictive approach, the signal section is defined as the part of the signal Y(t) which comprises a signal originating exclusively from one source segment. This is shown in FIG. 4B as the sections 430, resp. 440. In this way the part of the signal Y which is formed from signals of more than one source segment would be excluded. In FIG. 4B, section 435 is such a section. Preferably, all parts of the signal Y formed from a non-periodic source signal are taken into consideration for removal of introduced periodicity. To ensure that no parts are left out, sections such as 450 and 460 may be used , where the section starts at the point where for the first time a source segment contributes to the signal and ends at the point where for the first time another source segment starts contributing to the signal. Similarly, the section could be defined as the part which is half a segment later (i.e. the ending of a contribution of a segment is the determining point), like is the case for sections 470 and 480. Alternatively, the section may be defined as the stretch wherein one source segment provides the dominant contribution. In the case of the overlapping windows shown in FIGS. 1 and 3, the change from one section to another occurs then half way in between segments originating from different source segments as illustrated by sections 490 and 495 in FIG. 4B. It will be appreciated that normally several successive source segments will be non-periodic and the spectral content will only slowly change. As such, a very accurate alignment of the section is not required. Care must be taken at the boundaries in between a periodic and non-periodic section to ensure that no periodic signal is shuffled into the non-periodic part. It is, therefore, preferred to define such boundary section in a restrictive manner, for instance by using a definition like shown for section 470 for a change from a periodic signal to a non-periodic signal and a definition like for section 460 for a change from a non-periodic signal to a periodic signal.

Regardless of above definitions of the signal section, it is important to differentiate between a periodic and non-periodic source segment. Such a distinction may be made manually by analysing the signal, usually in a visual and audible representation, and storing such distinguishing information in association with the analysed portion of the source signal. Preferably, the signal is analysed automatically to determine the local pitch period. In principle any suitable known analysis method may be used. Such a method will also indicate if for a signal portion no pitch can be determined. If so, the identified portion can be divided into segments, each marked as non-periodic.

Once a signal section has been identified which is created by repeating a non-periodic source segment, as a next step the periodicity introduced into the section by the repetition is broken. This is achieved by dividing the signal section into segments and forming an output signal by shuffling the segments. The segments are formed in a manner as described earlier, by using windows and weighting the signal section according to the window functions. Since only a shuffling operation occurs and no pitch adjustment, it is not required to use overlapping segments. Advantageously, the same shape windows are used as were used to create the source segments. It will be appreciated that periodic signal sections are not affected and are simply maintained (if desired, the periodic sections may be broken into segments and re-combined at the same position to obtain the original signal section).

Figure 5:
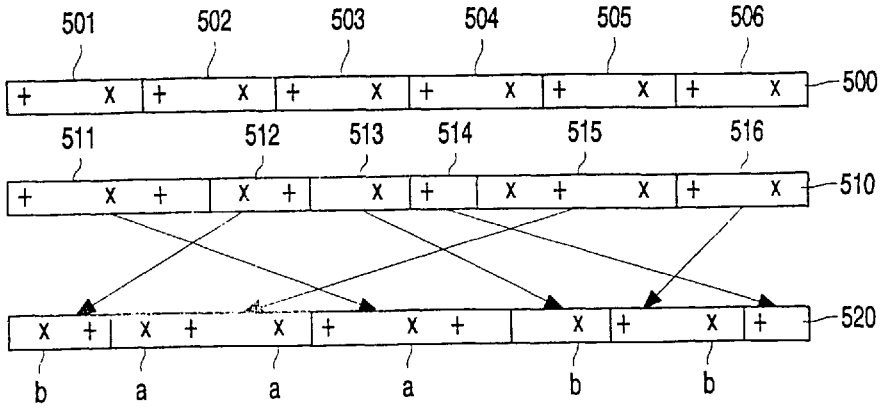
FIG. 5 illustrates shuffling segments of a non-periodic signal section.

FIG. 5. illustrates signal section 500 formed by six times repeating the same non-periodic source segment. The section is broken into a sequence 510 of segments 511, 512, 513, 514, 515, 516. In this example, sequence 510 also comprises six segments. As will be described in more detail later on, it is preferred to use more segments for sequence 510 than for the section 500. It will be appreciated that despite shuffling these segments the introduced periodicity would be kept if the segments of the sequence 510 exactly correspond to the segments 501, 502, 503, 504, 505, and 506 of the lengthened signal section 500. This situation is avoided by ensuring that at least one of the segments of the sequence 510 has a duration not equal to the duration of the source segment and not equal to a multiple of the duration of the source segment. In the example, segment 516 has the same duration as the source segment. All other segments of sequence 510 have a duration different from the duration of the source segment. In principle, segments of the sequence 510 may be longer than the source segment. In the example, segments 511 and 515 are longer. In such a situation, however, such a relatively long segment carries a repetitive element in it which can not be eliminated by shuffling. Nevertheless, even then some of the repetitiveness will be removed. To illustrate this, in the segments of the signal section 500 two spectral elements have been identified, using a "+" and an "×". The spectral elements are present in all of the segments in sequence 500 at the same location, resulting in both spectral elements contributing to the repetitiveness. In the shuffled section 520, the crosses at location a are repetitive, but only occur three times instead of six times. The crosses at location b are also repeated three times, but at a different location than α. So, even using non-optimal segments durations, such as segment 516, which has the same duration as the source segment, and segments 511 and 515, which are 1.5 times as long, still the repetitiveness has been significantly reduced.

In the example of FIG. 5 the following shuffling has taken place: segment 511 has been put at the third location; segment 512 at the first; segment 513 at the fourth; segment 514 at the sixth; segment 515 at the second and segment 516 at the fifth. Any suitable algorithm for shuffling may be used. For instance, the segments of sequence 510 may be allocated a new position number in sequence. In the example, sequence 510 comprises six segments. A new position number may be allocated to segment 511 by, for instance, using a random number generator to generate an integer number in the range 1 to 6. Next, a position number is allocated to segment 512, where the position number allocated to segment 511 may not be used. This process is repeated for all segments of sequence 510. Once all position numbers are known, the segments are incrementally placed, based on the position number and the duration of the segments. It is preferred that a separate shuffling operation is performed for each signal section 500, originating from different source segments. It will be appreciated that also more complicated shuffling algorithms may be used than the one described. For instance, a shuffling algorithm may be used, which further optimises the smearing over the section. As an example, the shuffling algorithm ensures that as much as possible the spectral content of successive segments in sequence 520 is different from the original sequence of spectral content. Also an optimisation procedure may be used which minimises the spectral repetitiveness, given the chosen division in segments.

It a further embodiment, at least some of the time windows used to form the second sequence 510 of segments have a duration substantially shorter than the duration of the source signal segment. Preferably all segments of the second sequence 510 are substantially shorter. In this way it is at least avoided that a segment of the sequence 510 itself carries a repetitive element in it. Furthermore, the number of segments increases, allowing for a statistically better distribution of spectral content.

In a further embodiment the duration of the short time windows is at least a factor 4 less than duration of the source signal segment. This breaks the spectral content of a segment of the section 500 into a sufficient number of pieces to allow the content to be reasonably smeared out. Very good results have been achieved by dividing individual segments of the signal section 500 over approximately 10 small segments. Even by limiting the shuffling to within individual segments of the section 500, the overall smearing on all segments of the section 500 significantly reduces the artefacts. Statistically, a better smearing may be obtainable to shuffling within the entire part of the lengthened signal which originates from the same source segment.

In a further embodiment, the durations of time windows of the second chain of time windows are selected from a predetermined range; the selected durations being substantially equally distributed over the range. By ensuring that the windows have different durations, it is avoided that potential artefacts occurring at the boundaries of the segments become repetitive and as such audible. The window durations may simply be linearly distributed over the range. For instance, if the range is from 1 msec. to 2 msec., 11 different window sizes may simply be chosen as 1 msec, 1.1 msec, 1.2 msec, etc.

It is preferred that an upper boundary of the range is at least a factor 1.5 higher than a lower boundary of the range.

Experiments have shown that this significantly reduces the audible artefacts. Particularly, using an upper boundary which is substantially a factor 2 higher than the lower boundary gives good results.

Figure 6A:
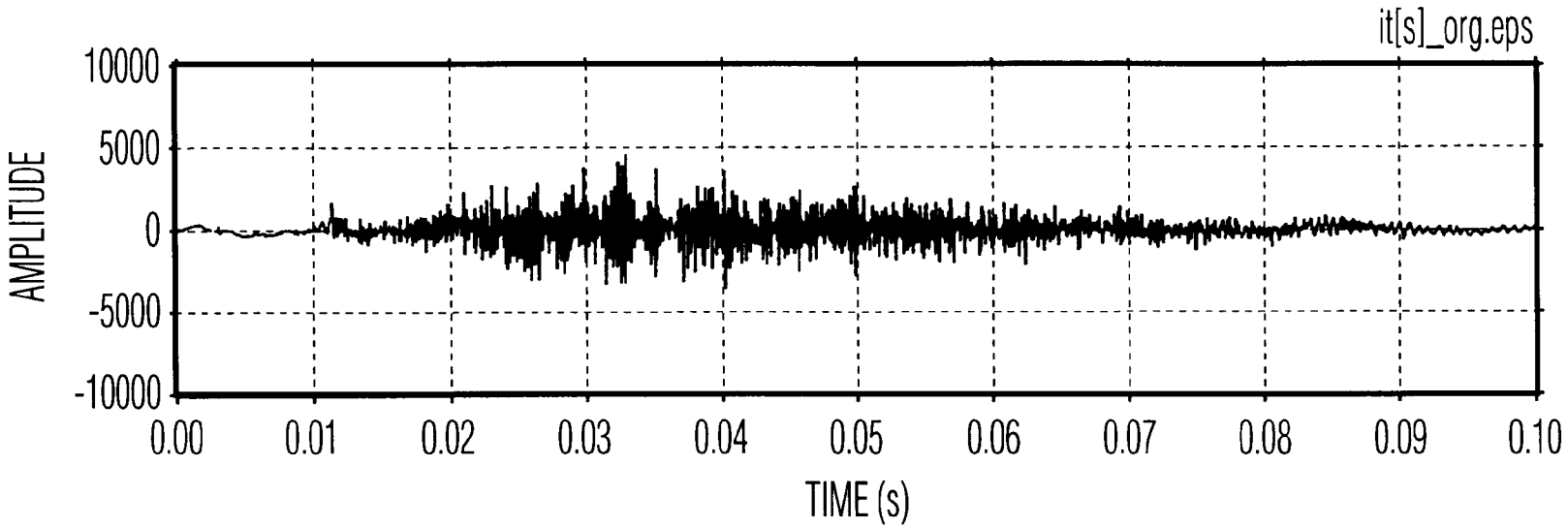
FIG. 6 shows an original non-periodic signal.
Figure 6B:
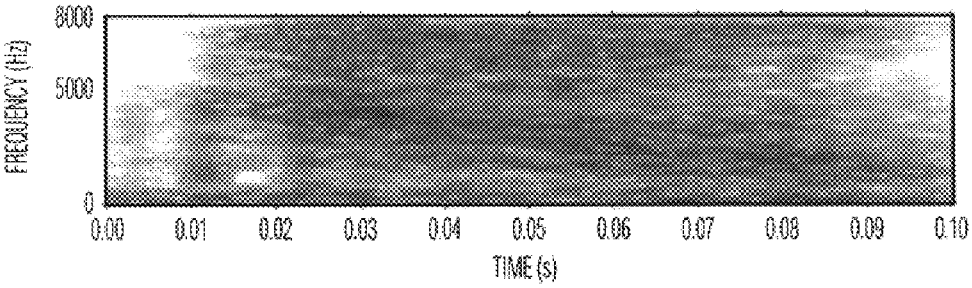
Figure 7B:
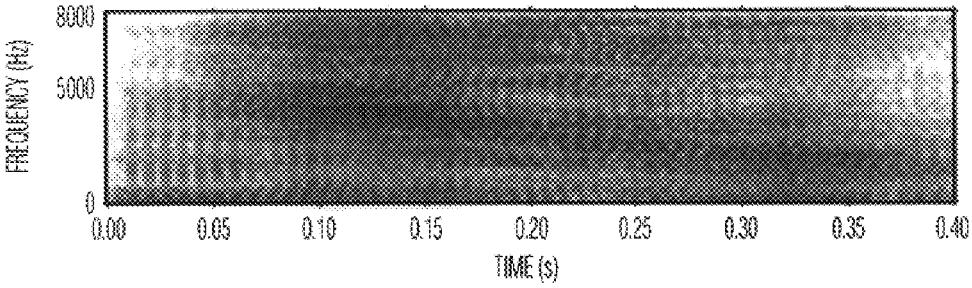
FIG. 7 shows the signal four times lengthened.
Figure 6C:
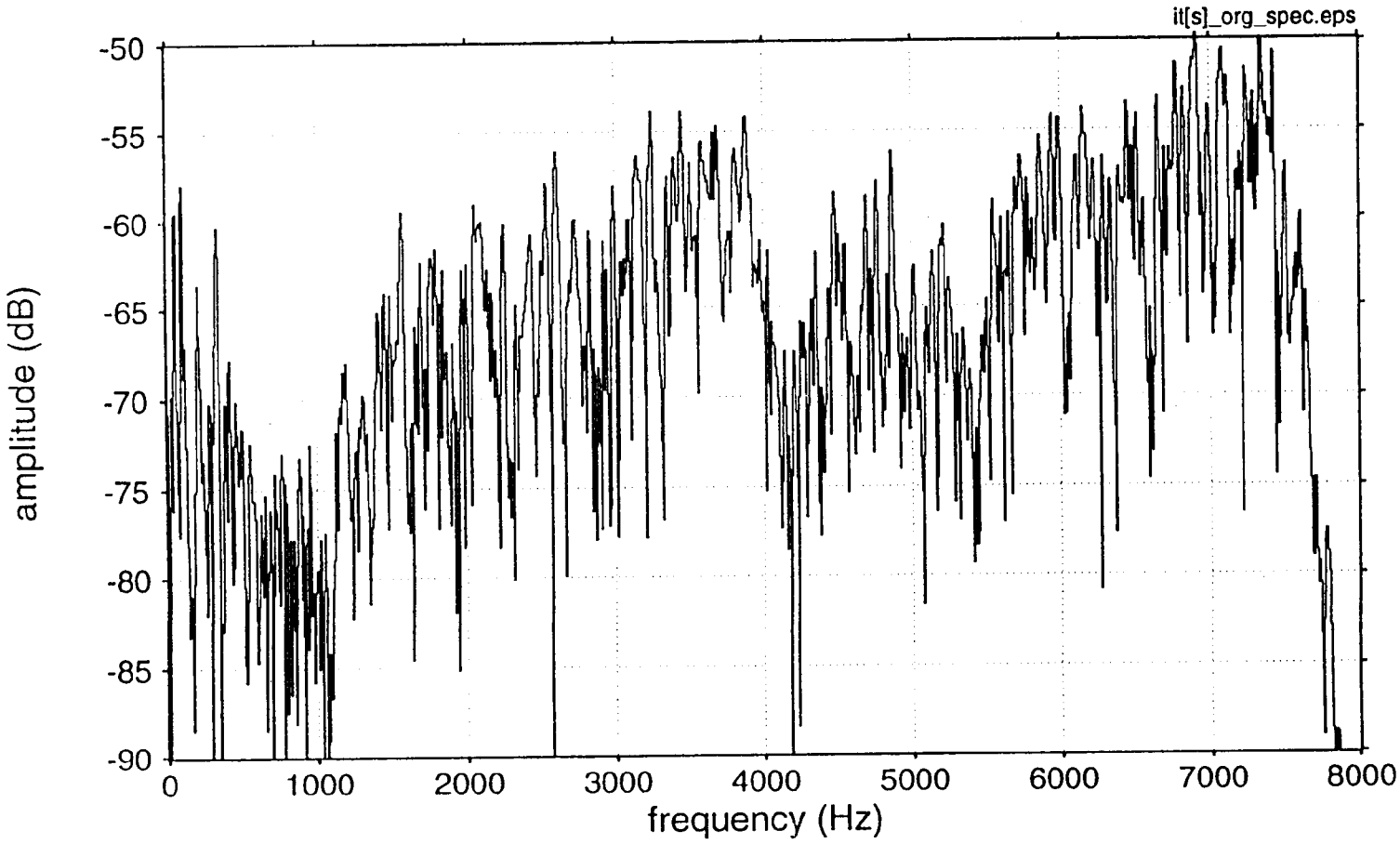
Figure 7A:
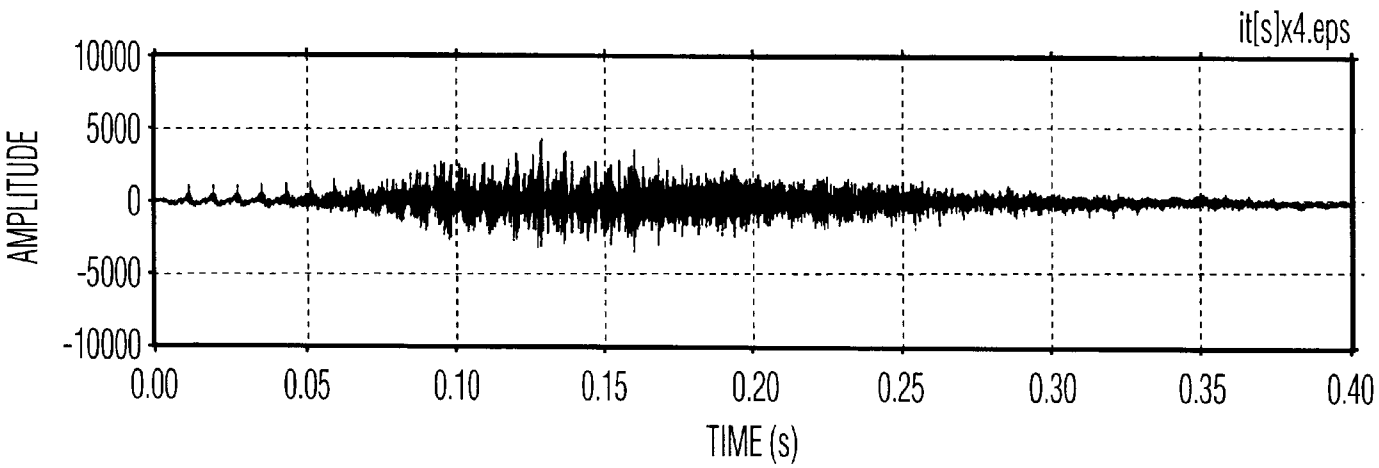
Figure 7C:
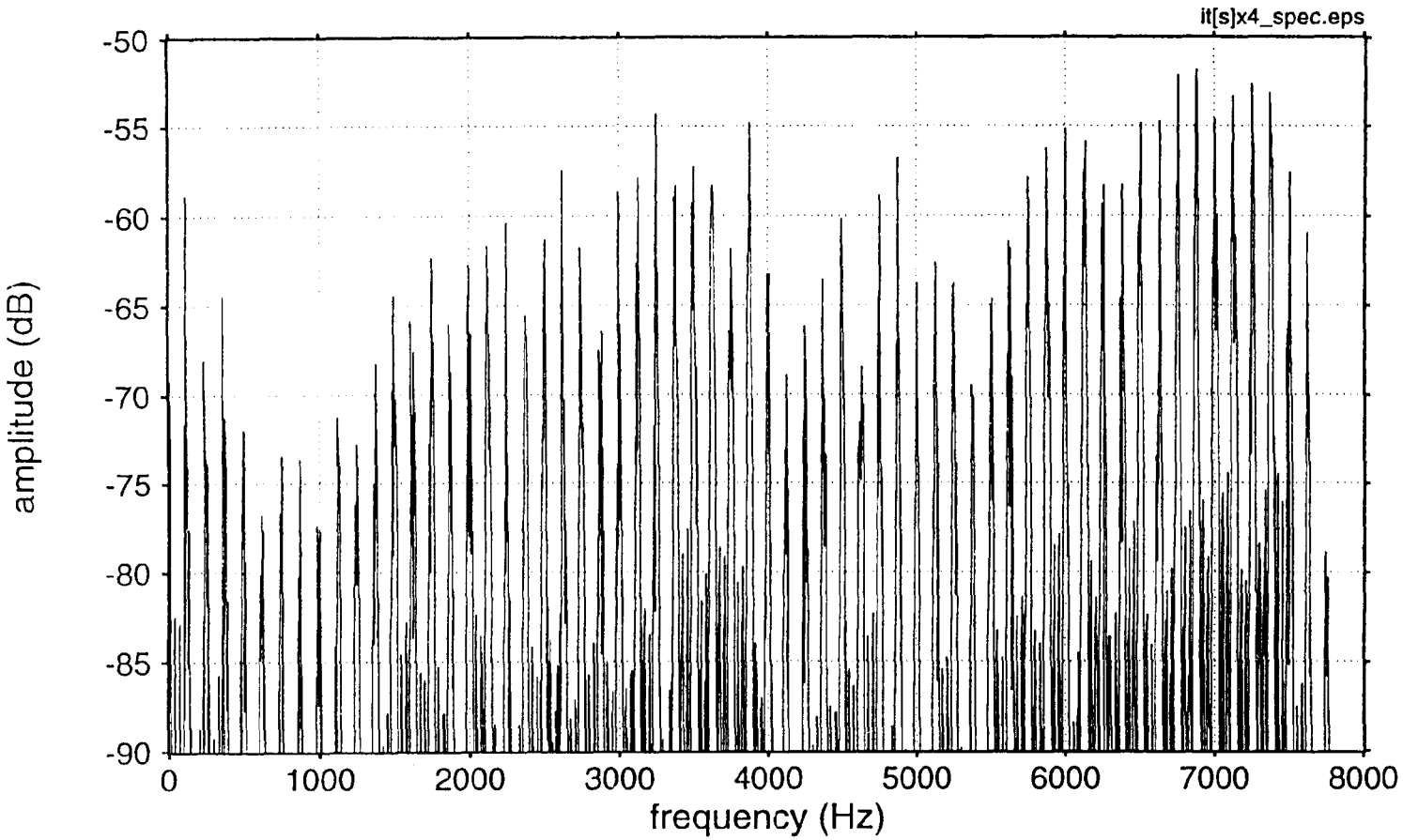
Figure 8A:
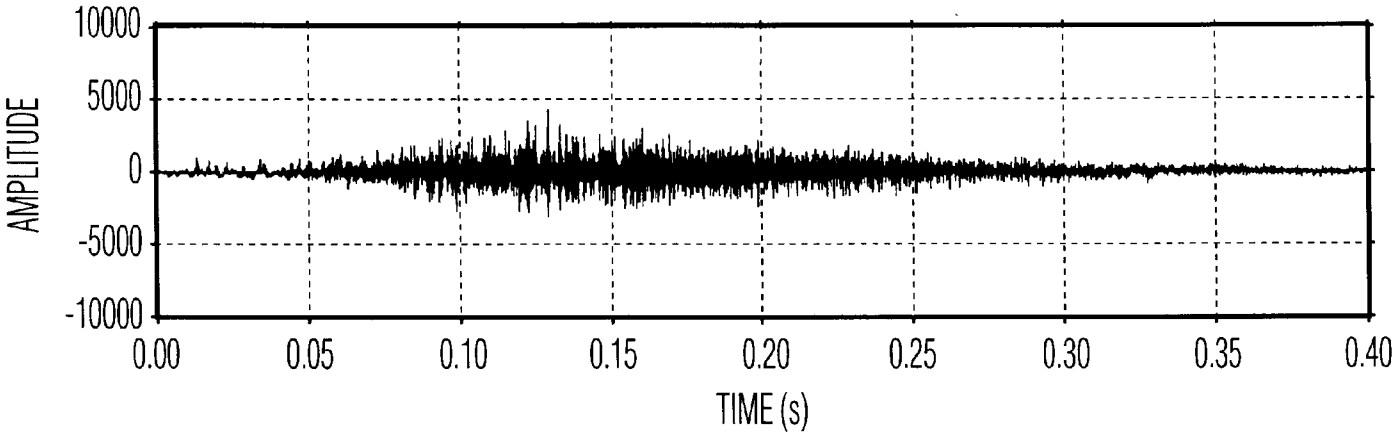
FIG. 8 shows the lengthened signal after shuffling fixed-size segments.
Figure 8B:
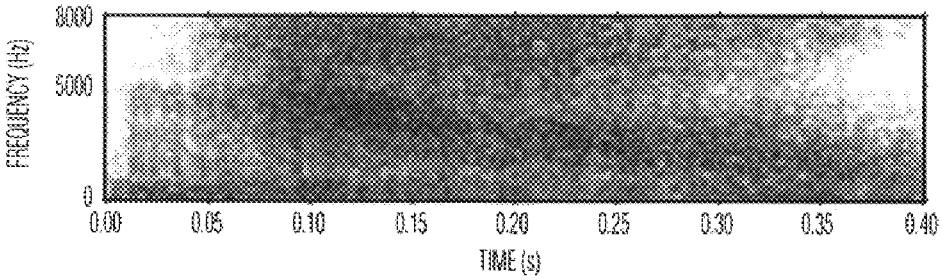
Figure 9B:
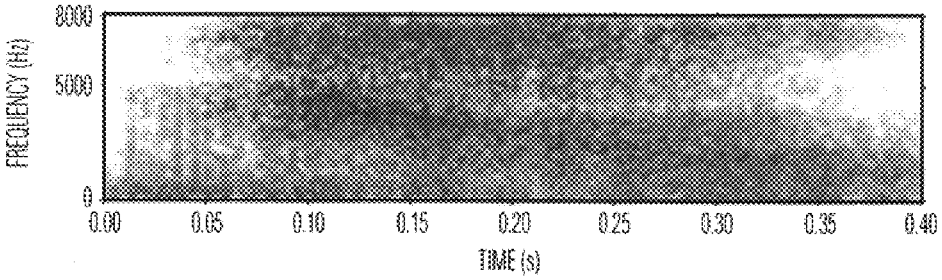
FIG. 9 shows the lengthened signal after shuffling variable-size segments.
Figure 8C:
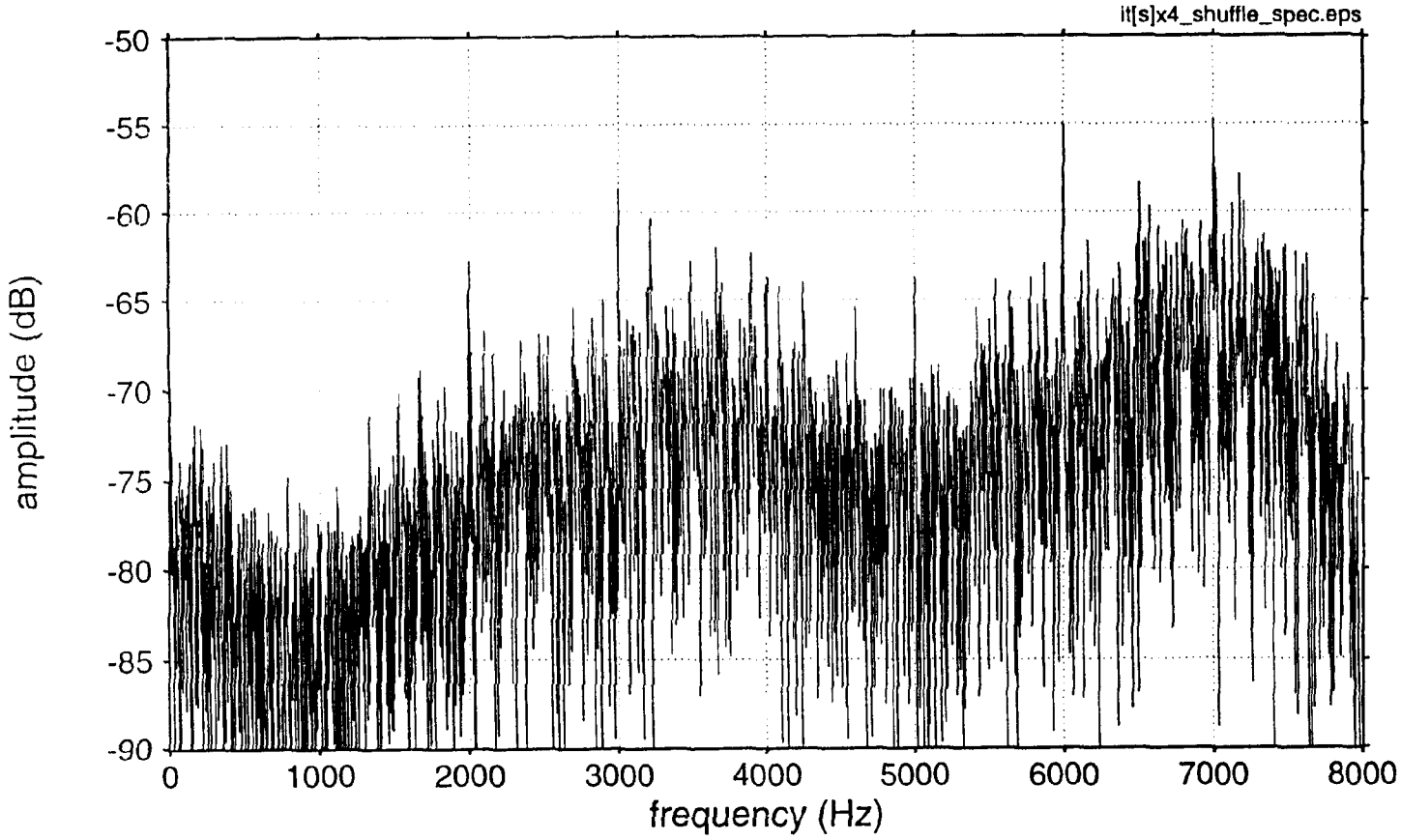
Figure 9A:
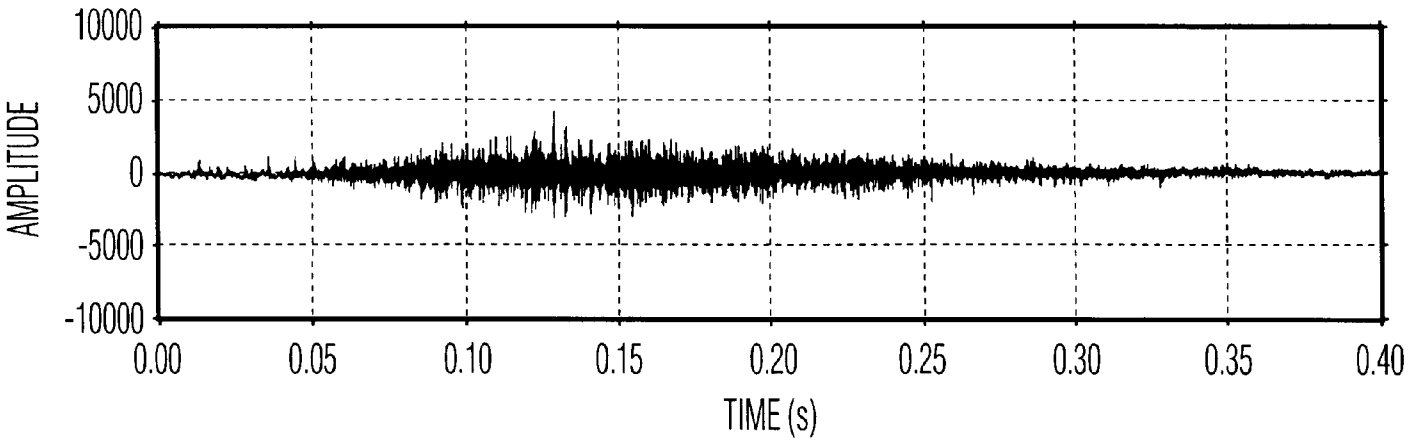
Figure 9C:
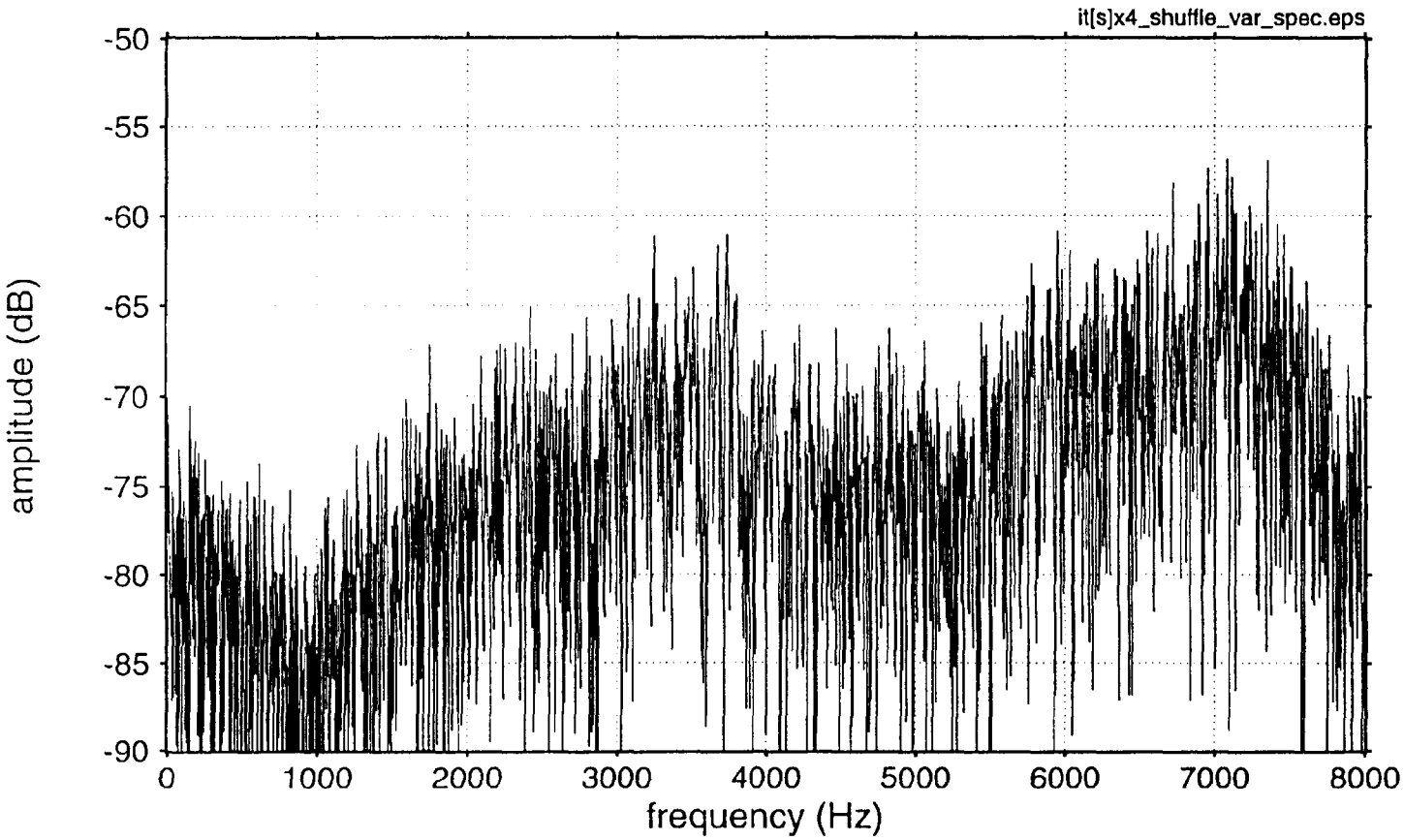

FIGS. 6, 7, 8 and 9 illustrate the performance of the method and apparatus according to the invention. For all FIGS., FIG. A illustrates the wave form (horizontally the time is indicated and vertically the amplitude of the signal). FIG. B illustrates the spectral content of the same signal, where the degree of darkness indicates the level of spectral content in the given frequency indicated vertically. FIG. C gives a detailed analysis of the spectral content over the entire signal. FIG. 6 shows an original voiceless stretch (the "s" in the English word its) for a male voice. FIG. 7 shows the same stretch lengthened by a factor of 4, using the prior art PIOLA technique. The introduced repetitiveness can be clearly identified (e.g. the series of peaks in FIG. 7A between 0 and 0.05 sec. The repetitiveness corresponds to the window displacement used for the lengthening the signal, being approximately 12 msec., FIG. 8 shows the same stretch, where the shuffling technique according to the invention has been used. A segment of the lengthened signal was divided into 10 smaller segments used for the shuffling. The smaller segments had equal size (windows with a constant duration were used). As can be seen, the repetitiveness has been removed almost entirely. FIG. 9 shows the same stretch, where the window size varies from 1 msec. to 2 msec. By comparing FIGS. 8C and 9C it can be observed that peeks noticeable in FIG. 8A at multiples of approximately 1000 Hz., caused by boundary artefacts using shuffling segments of a fixed duration of approximately 1 msec., have disappeared by using variable size shuffling segments.

Figure 10:
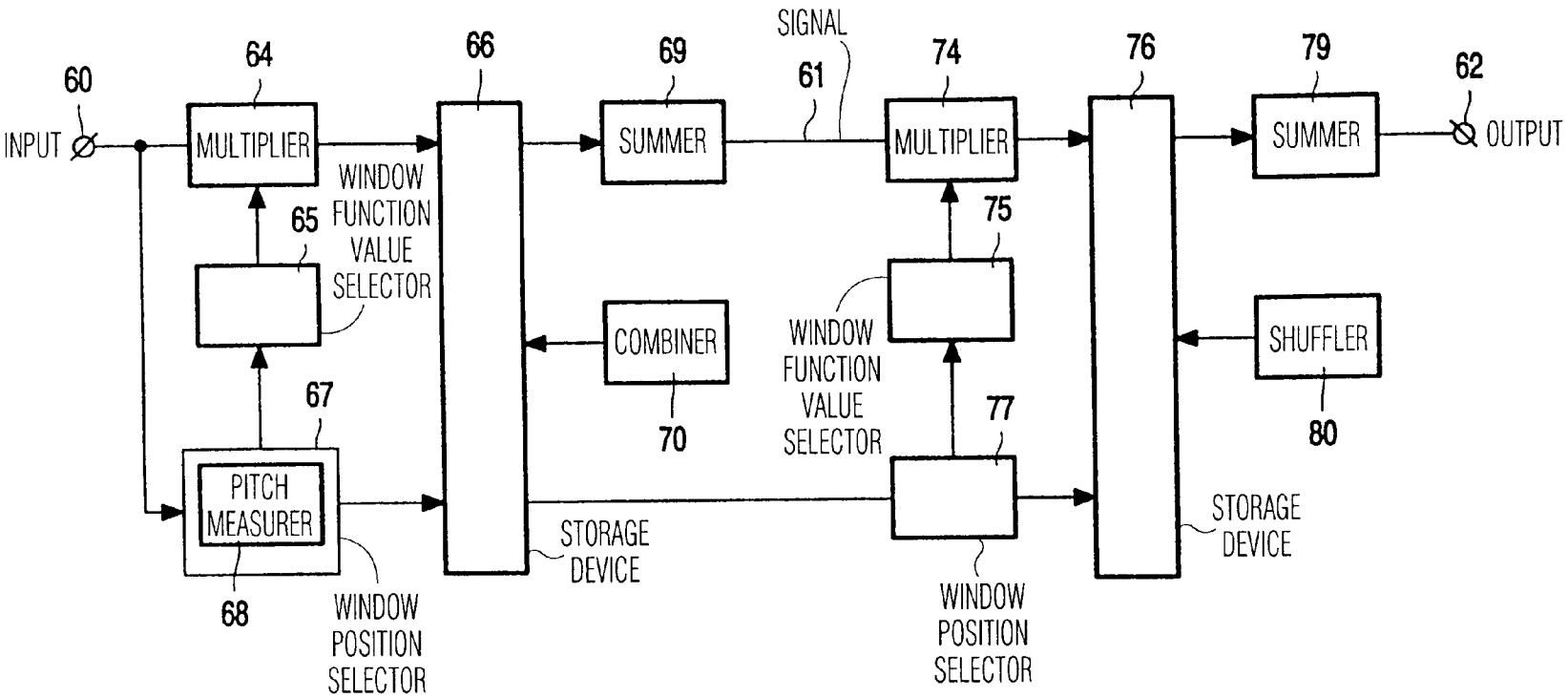
FIG. 10 shows a block diagram of an apparatus according to the invention.

The apparatus according to the invention can be implemented in a programmable audio processing system, for instance based on a DSP. Also dedicated hardware may be used. An exemplary apparatus is shown in FIG. 10. Since normally the same apparatus will also be used for lengthening the original signal, before removing the periodicity, this function is included in the Figure as well. The same apparatus can also be used for changing the pitch of the audio signal. The input audio equivalent signal arrives at an input 60; signal 61 represents the lengthened signal, and the lengthened signal from which periodicity has been removed leaves the apparatus (or is stored/processed further) at an output 62. The input signal is broken into segments by multiplying the signal by the window function in multiplication means 64. If overlapping windows are used, where at maximum two windows overlap, the multiplication means 64 may comprise two multipliers, each independently multiplying the input signal. The multiplication factors are supplied by window function value selection means 65. The segments are stored in the storage means 66 in segment slots in association with their respective time point values. This information is supplied by window position selection means 67. The window position selection means 67 comprises a pitch measurer 68, which determines whether a part of the input signal is periodic and, if so, the pitch value of the part. For a periodic part, the pitch value determines the duration scaling factor of the window, which is supplied to the window function value selection means 65. The pitch value also determines the duration of the segment and its position in the signal. This information is stored in the storage means 66, in association with the segment. If no period has been detected, default scaling factors may be used or, as described above, interpolation may be used to determine a suitable window duration. An indication whether or not the segment is periodic is also stored in the storage means 66 in association with the segment. The window function value selection means 65 combines the supplied duration scaling factor with a predetermined window function (which may be stored in a table) to determine the actual window value for each part of the input signal. If overlapping windows are used, where at maximum two windows overlap, window function value selection means 65 determines two window values in parallel.

To synthesis a lengthened signal 61, speech samples from various segments are summed in summing means 69. If no pitch manipulation is required and non-overlapping windows are used to create the segments, the summing means 69 is redundant. Combination means 70 controls which segments are read-out from the storage means for supply to the summing means 69. For lengthening, a lengthening factor supplied to the apparatus determines which of the stored segments needs to be repeated and the number of times a segment needs to be repeated, keeping the original relative timing difference of successive segments. A pitch scaling factor supplied to the apparatus determines how the relative timing difference must be changed.

In the Figure, the shuffling is shown as a separate post-processing phase. Similar as described before, signal sections originating from a non-periodic segment are broken into further segments by multiplying the signal by the window function in multiplication means 74. The window position selection means 77 uses the information stored in the storage means 66 to identify a section originating from one non-periodic segment. For sections originating from periodic segments no further operation is required. A periodic section may in its entirety be stored in the storage means 76 and retrieved at the appropriate moment. If desired, the periodic section may also be broken into segments, and stored as such in the storage means, to be exactly regenerated from the segments during retrieval. For a section originating from one non-periodic segment, the window position selection means 77 determines the number and duration of segments to be formed of the section and supplies the corresponding scaling factors to the window function value selection means 75. The window position selection means 77 stores the duration of the segments and their position in the signal in the storage means 76, in association with the segments created by the multiplication means 74. The window function value selection means 75 and the multiplication means 74 function the same as the described window function value selection means 65 and the multiplication means 64, and may, as such, be re-used in a time-sharing fashion. The segments are stored in the storage means 76 in segment slots in association with their respective time point values.

To synthesise a lengthened signal 62 with removed periodicity, speech samples from various segments are summed in summing means 79. If non-overlapping windows are used by the window function value selection means 75 to create the segments, the summing means 79 is redundant. Shuffling means 80 controls which segments are read-out from the storage means for supply to the summing means 69. The shuffling means 80 maintains the sequence within periodic sections of the signal 61 and shuffles the segments originating from the same non-periodic segment.

What is claimed is:

1. A method for lengthening an audio equivalent input signal, the method comprising the steps of:

positioning a first chain of mutually overlapping or adjacent time windows with respect to the signal, each time window being associated with a respective window function;

forming a first sequence of signal segments by weighting the signal according to the associated window function of a respective window of the first chain of windows; and synthesising a lengthened audio signal by systematically maintaining or repeating respective signal segments of the first sequence of signal segments;

identifying a signal section in the lengthened audio signal which is synthesised from one of the signal segments, referred to as a source signal segment, by maintaining and at least once repeating the source signal segment; the source signal segment substantially having no periodic component; and breaking periodicity in the signal section caused by repeating the source signal segment by positioning a second chain of mutually overlapping or adjacent time windows with respect to the signal section; at least some of the time windows of the second chain having a duration not equal to a duration of the source signal segment and not equal to a multiple of the duration of the source signal segment;

forming a second sequence of signal segments by weighting the signal section with the associated window function of a respective window of the second chain of windows; and generating an audio output signal from the lengthened audio signal by shuffling signal segments of the second sequence of signal segments.

2. The method as claimed in claim 1, wherein at least a selection of the time windows of the second chain of time windows have a substantial shorter duration than the duration of the source signal segment.

3. The method as claimed in claim 2, wherein the duration of the selection of the time windows of the second chain is at least a factor 4 less than duration of the source signal segment.

4. The method as claimed in claim 1, wherein the durations of time windows of the second chain of time windows are selected from a predetermined range; the selected durations being substantially equally distributed over the range.

5. The method as claimed in claim 4, wherein an upper boundary of the range is at least a factor 1.5 higher than a lower boundary of the range.

6. The method as claimed in claim 4, wherein the upper boundary is substantially a factor of two higher than the lower boundary.

7. An apparatus for lengthening an audio equivalent input signal, the apparatus comprising:

positioning means for positioning a first chain of mutually overlapping or adjacent time windows with respect to the signal, each time window being associated with a respective window function;

segmenting means for forming a first sequence of signal segments by weighting the signal according to the associated window function of a respective window of the first chain of windows; and synthesising means for synthesising a lengthened audio signal by systematically maintaining or repeating respective signal segments of the first sequence of signal segments, characterised in that the apparatus comprises:

identification means for identifying a signal section in the lengthened audio signal which is synthesised from one of the signal segments, referred to as a source signal segment, by maintaining and at least once repeating the source signal segment, the source signal segment substantially having no periodic component; and means for breaking periodicity in the signal section caused by repeating the source signal segment by causing the positioning means to position a second chain of mutually overlapping or adjacent time windows with respect to the signal section; at least some of the time windows of the second chain having a duration not equal to a duration of the source signal segment and not equal to a multiple of the duration of the source signal segment;

causing the segmenting means to form a second sequence of signal segments by weighting the signal section with the associated window function of a respective window of the second chain of windows; and generating an audio output signal from the lengthened audio signal by shuffling signal segments of the second sequence of signal segments.

8. The apparatus as claimed in claim 7, wherein at least a selection of the time windows of the second chain of time windows have a substantial shorter duration than the duration of the source signal segment.

9. The apparatus as claimed in claim 7, wherein the durations of time windows of the second chain of time windows are selected from a predetermined range; the selected durations being substantially equally distributed over the range.

* * * * *